US007607325B2

(12) United States Patent
Elexpuru et al.

(10) Patent No.: US 7,607,325 B2
(45) **Date of Patent: *Oct. 27, 2009**

(54) HYDRAULIC DISTRIBUTOR FOR A WASHING MACHINE

(75) Inventors: Antón Elexpuru, Mondragón (ES); Roman Balanzategui, Mondragón (ES)

(73) Assignee: Coprecitec, S.L., Aretxabaleta (Gipuzkoa) (ES)

( * ) Notice: Subject to any disclaimer, the term of this patent is extended or adjusted under 35 U.S.C. 154(b) by 695 days.

This patent is subject to a terminal disclaimer.

(21) Appl. No.: 11/248,916

(22) Filed: Oct. 11, 2005

(65) Prior Publication Data

US 2006/0081017 A1 Apr. 20, 2006

(51) Int. Cl.
*D06F 29/00* (2006.01)

(52) U.S. Cl. ..... 68/12.18; 68/12.19; 68/207

(58) Field of Classification Search ..... 68/12.18, 68/207; 137/875; 251/228, 298
See application file for complete search history.

(56) References Cited

U.S. PATENT DOCUMENTS 2,699,318 A * 1/1955 Ellison et. al. ..... 251/158
5,791,168 A * 8/1998 Smock et al. ..... 68/12.18
2004/0244437 A1 * 12/2004 Elexpuru et al. ..... 68/13 R

FOREIGN PATENT DOCUMENTS

EP 1029965 A1 8/2000

OTHER PUBLICATIONS

Machine Translation of Gagnaire et al. EP 1029965 A1, Aug. 2000.*

* cited by examiner

*Primary Examiner*—Michael Barr
*Assistant Examiner*—David Cormier
(74) *Attorney, Agent, or Firm*—Tim L. Kitchen; Peter B. Scull; Berenbaum Weinshienk PC

(57) ABSTRACT

A hydraulic distributor for a washing machine that comprises a rotating drive shaft (7), a distribution nozzle (30) that rotates jointly with the drive shaft (7) and diverts the water to a plurality of compartments, a hydraulic body (2) that comprises a emptying pipe (10), a draining pipe (11) and an exit pipe (15) for re-circulation, and a valve body (6) housed inside said hydraulic body (2). The valve body (6) comprises an obturator (60) that pivots with respect to an axis (61), and an arm (62) that rotates jointly with the drive shaft (7), the rotation of said arm (62) causing said obturator (60) to oscillate between a first position in which the obturator (60) closes the draining pipe (11) and a second position in which the obturator (60) closes the exit pipe (15).

5 Claims, 7 Drawing Sheets

HYDRAULIC DISTRIBUTOR FOR A WASHING MACHINE

TECHNICAL FIELD

The present invention relates to hydraulic distributors for home appliances such as washing machines.

PRIOR ART

In washing machines, it is essential to control the entry of water from the mains to different compartments of the washing machine tray (pre-wash, wash, fabric softener, bleach, etc.). To do so, separate electrovalves for each compartment, a combination of electrovalves or indeed a single electrovalve with mechanisms for guiding the entry of water can be used.

Washing machines are known in which the movement of an electromechanical programmer acts on an actuating mechanism which successively activates the flow of water to the different compartments. Washing machines are also known which use an electronic programmer, which drives a guiding mechanism analogous to that of washing machines with an electromechanical programmer using, for example, a micromotor.

Washing machines also have a draining function, connecting an emptying pipe to a draining pipe to empty the waste water. Washing machines are known which include a motor pump for this purpose.

Another function that washing machines may include is the re-circulation function, whereby the water is re-circulated from the emptying pipe to the washing machine drum during the washing cycles. Washing machines are known which include a second motor pump for carrying out this function and other washing machines are known which use a single motor pump for draining and re-circulating.

EP 1029965 A1 discloses a hydraulic distributor which comprises a rotating body suitable for selectively distributing the water from an inlet pipe to a plurality of exit pipes connected to the compartments of the tray of the washing machine. Said rotating body turns by motorized means.

Together with the hydraulic distributor, there is a re-circulation unit which comprises a casing with an emptying pipe, a draining pipe and a re-circulation pipe, and also includes a pivoting flap which can seal off the draining pipe or the re-circulation pipe. The flap is moved by the motorized means via intermediate elements that include a lever.

DISCLOSURE OF THE INVENTION

The main object of the invention is to provide a hydraulic distributor that diverts the supply of water from the mains to the compartments in the washing machine tray and which also allows emptying and re-circulation.

The hydraulic distributor of the invention comprises a rotating drive shaft, a distribution nozzle that rotates jointly with the drive shaft, said distribution nozzle diverting the water supply taken from the mains to a plurality of compartments in the washing machine, a hydraulic body that comprises an emptying pipe, a draining pipe and an exit pipe for re-circulation, and a valve body housed inside said hydraulic body.

The valve body comprises an obturator that pivots with respect to a shaft, and an arm that rotates jointly with the drive shaft, the rotation of said arm causing said obturator to oscillate between a first position in which the obturator closes the draining pipe and a second position in which the obturator closes the exit pipe.

The use of the hydraulic distributor of the invention means that specific devices for emptying and re-circulation are not required and that the use of more than one electrovalve or more than one motor pump is not necessary. As a consequence, the structure and the washing machine connection system are made simpler, thereby making the washing machine quicker to assemble, helping to reduce costs significantly.

Furthermore, the fact that the emptying and re-circulation device is incorporated inside the hydraulic body means that the distributor of the invention is compact, robust and easy to assemble.

Other objects, features and advantages will become apparent from the following detailed description of the invention and the drawings.

DETAILED DISCLOSURE OF THE INVENTION

Figure 1:
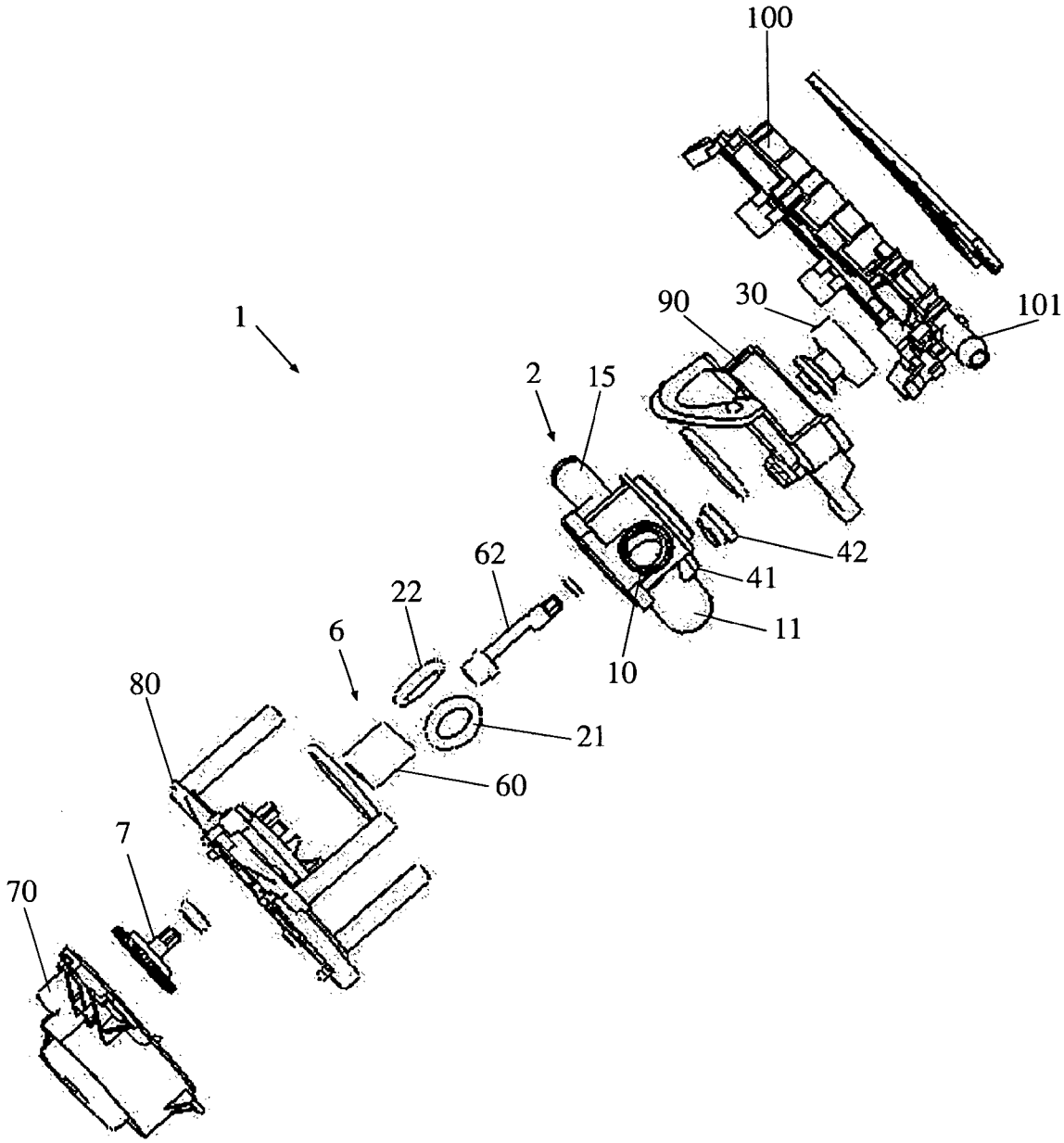
FIG. 1 is an exploded perspective view of an embodiment of the hydraulic distributor of the invention.

Referring to FIG. 1, the hydraulic distributor 1 of the invention comprises:

- a rotating drive shaft 7;
- a distribution nozzle 30 that rotates jointly with the drive shaft 7, said distribution nozzle 30 diverting the supply of water from the mains to a plurality of compartments (not shown in the figures) in the washing machine;
- a hydraulic body 2 that comprises a emptying pipe 10, a draining pipe 11 and an exit pipe 15 for the re-circulation; and
- a valve body 6 housed inside said hydraulic body 2.

The drive shaft 7 is rotated by a motor (not shown in the figures) housed in a lower casing 70 and connected to the drive shaft 7 by gearing means. The casing 70 is attached to a base member 80 onto which the hydraulic body 2 is clipped.

The drive shaft 7 is connected to the valve body 6. Thus, by rotating the drive shaft 7 the valve body 6 can be positioned, thereby diverting the water supplied to the hydraulic body 2 from the emptying pipe 10 as a result of the action of a discharge motor (not shown in the figures) either to the draining pipe 11 or the exit pipe 15 for re-circulation.

The distribution nozzle 30 of the distributor of the invention rotates jointly with the drive shaft 7, said distribution nozzle 30 carrying the supply of water from the mains to the corresponding compartment in the washing machine in accordance with its angular position. As can be inferred from FIG. 1, said distribution nozzle 30 rotates jointly with the valve body 6.

Figure 2:
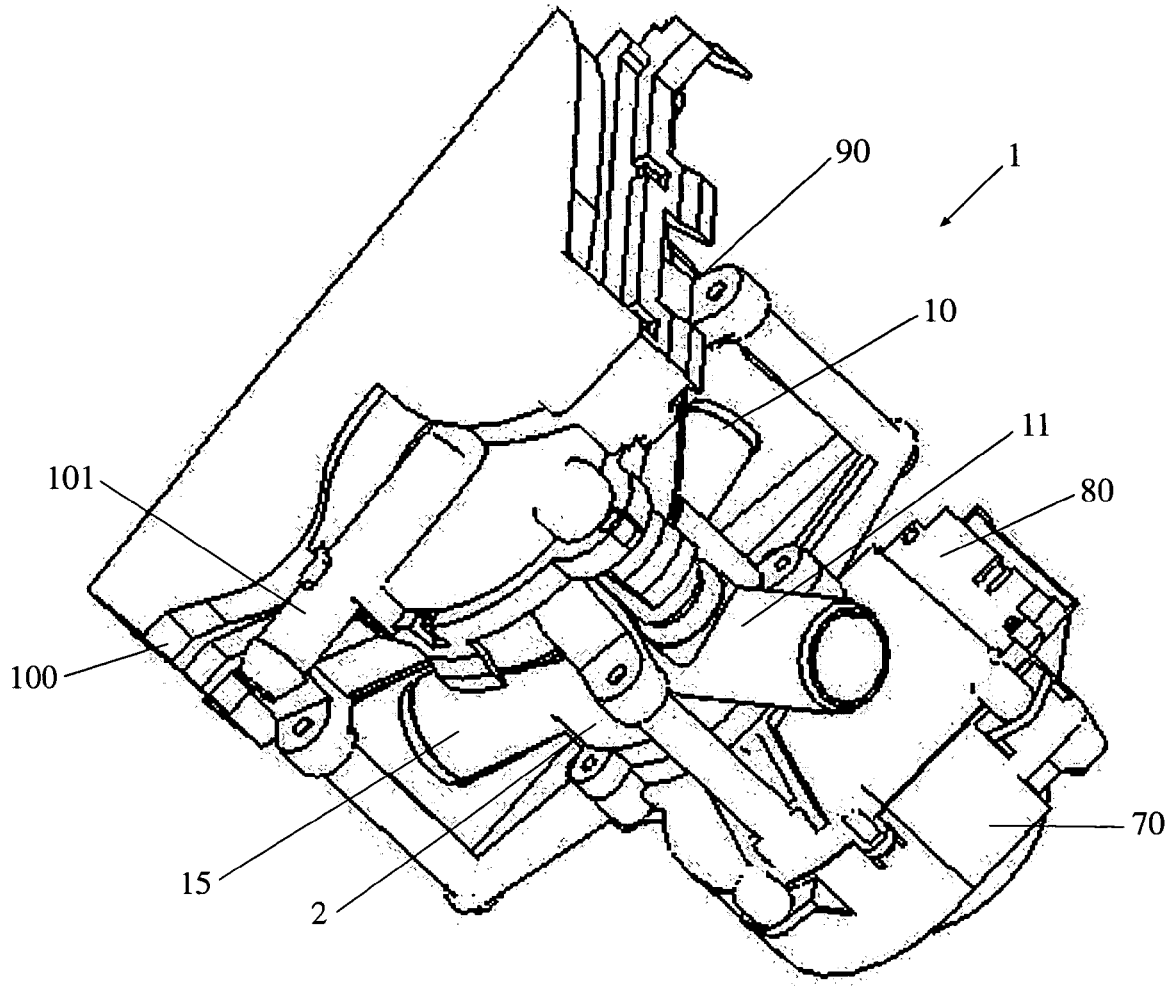
FIG. 2 is a perspective view of the embodiment of FIG. 1.

The distribution nozzle 30 is placed on a housing 90 that is connected to the upper face of the hydraulic body 2. The hydraulic body 2 is held between the base member 80 and the housing 90. Finally, an upper casing 100 is placed on said housing 90. Said upper casing 100 comprises an inlet duct 101 from which the supply of water from the mains is carried to the distribution nozzle 30. FIG. 2 shows how the hydraulic distributor is assembled in the described embodiment.

Figure 3A:
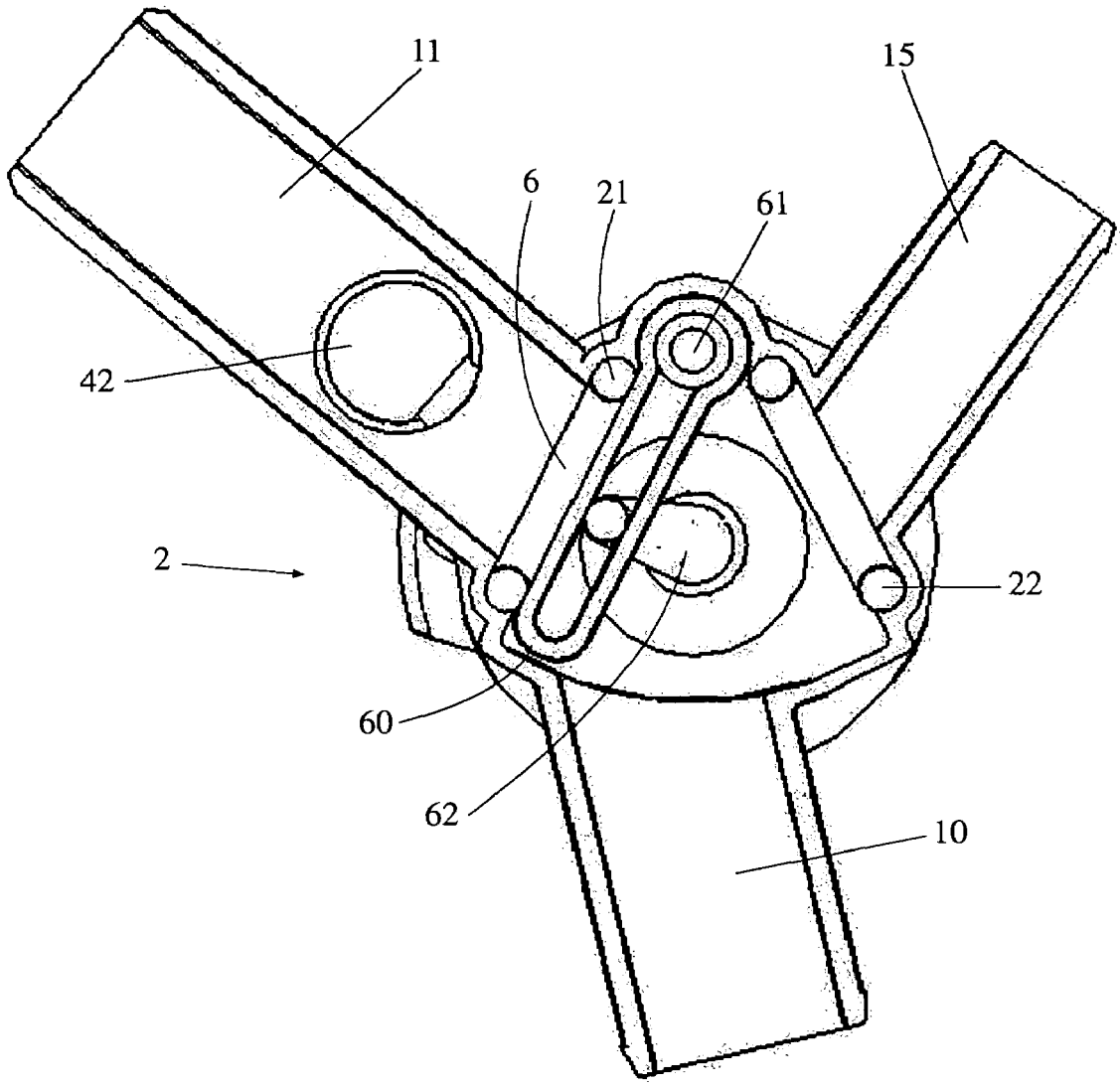
FIG. 3A is a cross-sectional view of the hydraulic body and the valve body of the embodiment of FIG. 1, with said valve body in a first position.
Figure 3B:
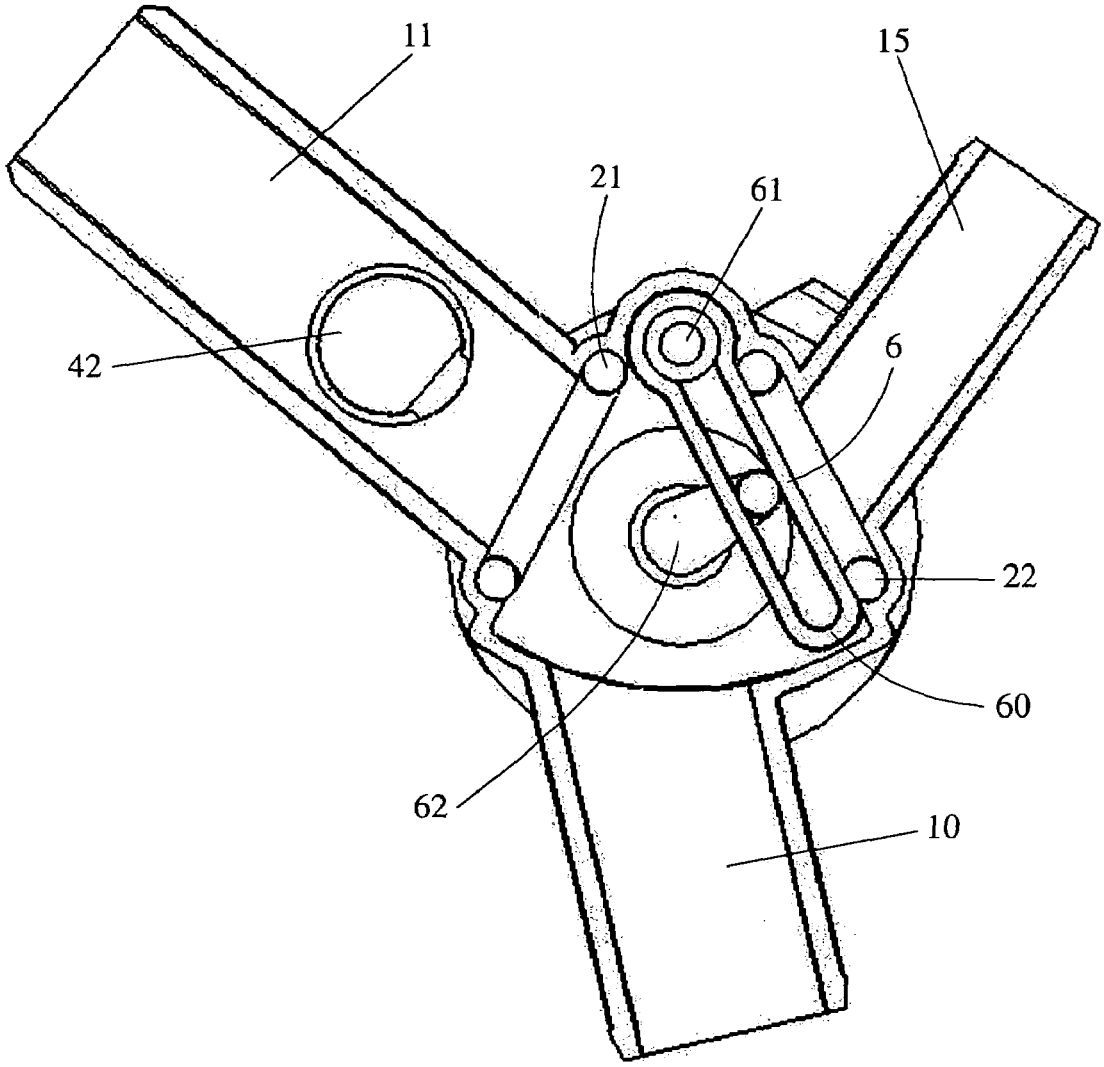
FIG. 3B is a cross-sectional view of the hydraulic body and the valve body of the embodiment of FIG. 1, with said valve body in a second position.

Referring now to FIGS. 3A and 3B, the valve body 6 comprises an obturator 60 that pivots with respect to an axis 61, and an arm 62 that rotates jointly with the drive shaft 7, the rotation of said arm 62 causing said obturator 60 to oscillate between a first position, shown in FIG. 3A, in which the obturator 60 closes the draining pipe 11 and a second position, shown in FIG. 3B, in which the obturator 60 closes the exit pipe 15. In the first position, the obturator 60 leans against an O-ring seal 21 placed at the opening of the draining pipe 11, and in the second position said obturator 60 leans against an O-ring seal 22 placed at the opening of the exit pipe 15.

Figure 4A:
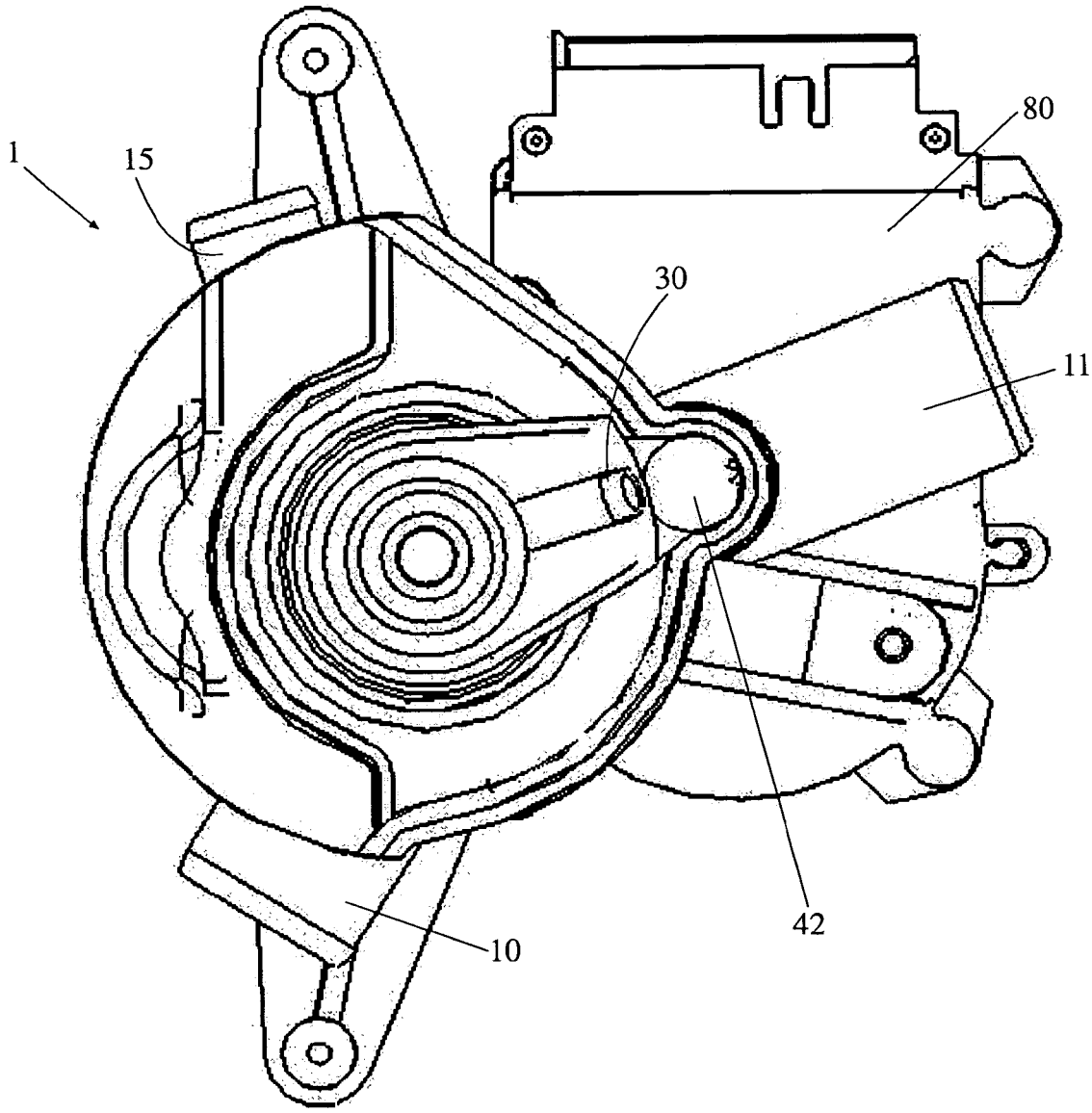
FIG. 4A is a ground view of the embodiment of FIG. 1, in which the upper casing of said embodiment has been eliminated, with the valve body in a first position.

Said first position of the obturator 60, the one corresponding to FIG. 3A, corresponds with a position of the distribution nozzle 30, shown in FIG. 4A, in which said distribution nozzle 30 carries the water supplied from the mains to the draining pipe 11. As said FIG. 4A shows, in said position the water carried along the distribution nozzle 30 reaches the draining pipe 11 through a valve 42 placed in an orifice 41 in the draining pipe 11. In this way, given that the valve body 6 and the distribution nozzle 30 rotate jointly with each other at all times, even if other elements in the washing machine fail, any excess water inside the machine will always be guided to the draining pipe 11.

Figure 4B:
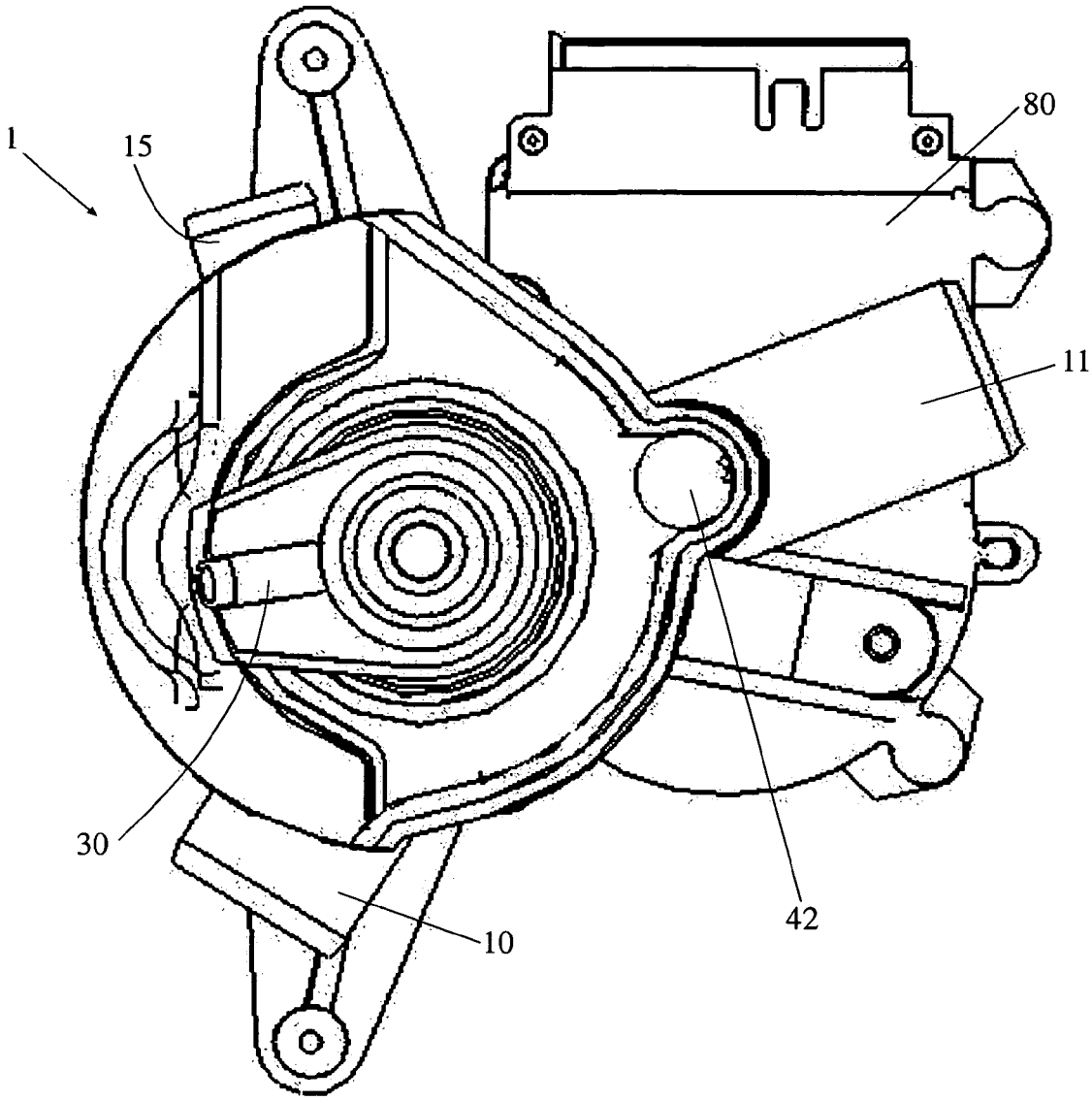
FIG. 4B is a ground view of the embodiment of FIG. 1, in which the upper casing of said embodiment has been eliminated, with the valve body in a second position.

The second position of the obturator 60, the one corresponding to FIG. 3B, corresponds with a position, shown in FIG. 4B, in which the distribution nozzle 30 diverts the supply of water from the mains to a certain compartment in the washing machine.

Between said first and second positions there are a plurality of intermediate positions that correspond with positions in which the distribution nozzle 30 diverts the water to different compartments in the washing machine. In said intermediate positions, the obturator 60 diverts the water towards the draining pipe 11.

Figure 5:
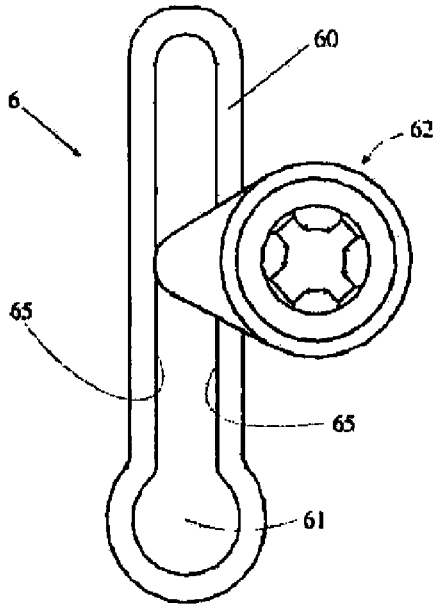
FIG. 5 is a ground view of an embodiment of the valve body of the hydraulic distributor of the invention.
Figure 6:
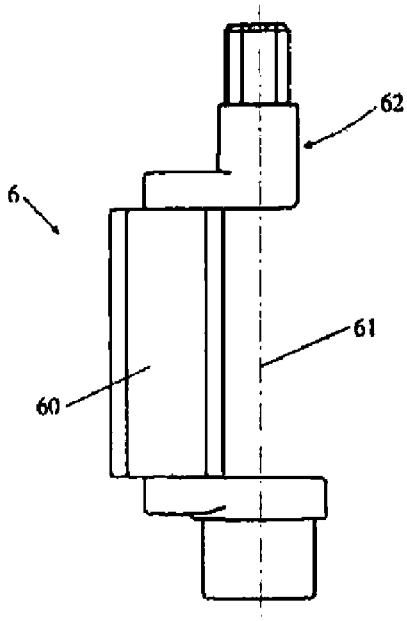
FIG. 6 is an elevated view of the valve body of the embodiment of FIG. 5.
Figure 7:
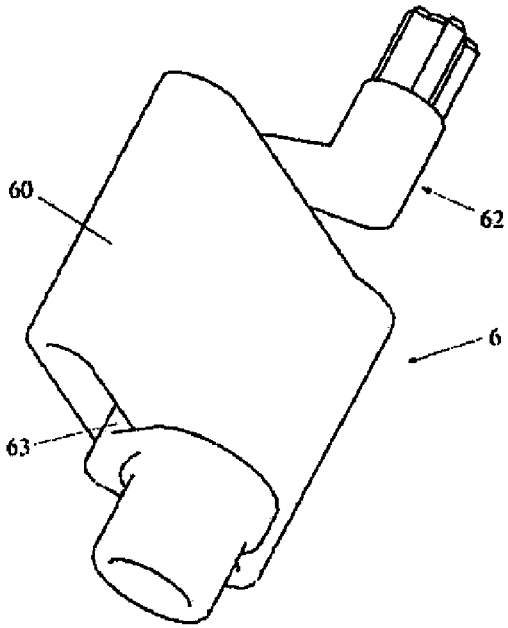
FIG. 7 is a perspective view of the valve body of the embodiment of FIG. 5.

The obturator 60, shown together with the arm 62 in FIGS. 5 to 7, comprises opposing flat wall 65 that forms in part a closed unit. The arm 62 comprises a segment 63 parallel to the axis of rotation of said arm 62, said segment 63 being housed in the closed unit of the obturator 60. Thus, when the arm 62 rotates said segment 63 pushes the flat wall 65 thereby causing the obturator 60 to oscillate.

In the embodiment shown in the figures, the drive shaft 7, the arm 62 and the distribution nozzle 30 are coaxial, and the distributor 1 forms the compact unit of FIG. 2. However, other embodiments can be designed in which this is not the case. It may be the case, for example, that because of space-related problems inside the body of the washing machine, the distribution nozzle 30 has to be separated from the other elements in the hydraulic distributor 1 of the invention. In such a case, said hydraulic distributor 1 should incorporate, in order to transmit the rotation of the drive shaft 7 to the distribution nozzle 30, transmission means such as a rotating shaft connected by gearing means to said drive shaft 7 and said distribution nozzle 30.

The invention claimed is:

1. A water flow distributor for a washing machine comprising:

a rotating drive shaft having a first rotating axis;

a distribution nozzle that rotates jointly with the drive shaft, the distribution nozzle having a second rotating axis coaxial to the first rotating axis and configured to divert the supply of water from a water supply to a plurality of compartments in the washing machine in accordance with its angular position;

a hydraulic body that comprises an emptying pipe, a draining pipe having a first valve seating surface, and an exit pipe having a second valve seating surface;

a valve body housed inside the hydraulic body, the valve body comprising first and second opposing sealing surfaces that at least in part define an elongate slot positioned between the sealing surfaces, the first sealing surface configured to be positioned in a first engagement position with the first valve seating surface to impede flow through the draining pipe, the second sealing surface configured to be positioned in a second engagement position with the second valve seating surface to impede water flow through the exit pipe; and an arm having a first end coupled to the rotating drive shaft and having a third rotating axis that is coaxial with the first rotating axis, the arm having a segment parallel to the third rotating axis that extends through the elongate slot of the valve body, rotation of the arm causing the segment to act upon the valve body to cause the valve body to oscillate between the first and second engagement positions.

2. The water flow distributor of claim 1 wherein the draining pipe has a sidewall with an opening therein, the angular position of the distribution nozzle being aligned to direct water into the opening when the valve body is in the first engagement position.

3. The water flow distributor of claim 2 further comprising a valve disposed in the opening.

4. The water flow distributor of claim 1 wherein the angular position of the distribution nozzle is aligned to direct water from the water supply to one or more compartments in the washing machine when the valve body is in the second engagement position.

5. The water flow distributor of claim 1 wherein the first end of the arm and the segment parallel to the third rotating axis of the arm are integrally formed.

* * * * *